US009688447B2

(12) United States Patent
Murray

(10) Patent No.: US 9,688,447 B2
(45) Date of Patent: Jun. 27, 2017

(54) POUCH WITH CHILD PROOF FITMENT

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days.

(21) Appl. No.: 14/873,667

(22) Filed: Oct. 2, 2015

(65) Prior Publication Data

US 2016/0096666 A1 Apr. 7, 2016

Related U.S. Application Data

(60) Provisional application No. 62/058,849, filed on Oct. 2, 2014.

(51) Int. Cl.
*B65D 50/04* (2006.01)
*B65D 75/58* (2006.01)

(52) U.S. Cl.
CPC ..... *B65D 50/041* (2013.01); *B65D 50/046* (2013.01); *B65D 75/5883* (2013.01); *B65D 2215/06* (2013.01)

(58) Field of Classification Search
CPC ..... B65D 25/42; B65D 25/48; B65D 35/00; B65D 35/02; B65D 35/12; B65D 35/42; B65D 41/04; B65D 41/0414; B65D 41/16; B65D 41/165; B65D 41/4085; B65D 47/06; B65D 47/10; B65D 47/12; B65D 47/122; B65D 50/00; B65D 50/041; B65D 50/046; B65D 51/16; B65D 51/1688; B65D 75/58; B65D 75/5883; B65D 2215/06
USPC ..... 222/92, 107, 541.6–541.9, 566–568; 206/459.1, 459.5
See application file for complete search history.

(56) References Cited

U.S. PATENT DOCUMENTS

| | | | | |
|---|---|---|---|---|
| 6,991,140 | B2 * | 1/2006 | Bourque | B65D 75/5883 222/107 |
| 9,221,592 | B2 * | 12/2015 | Murray | B65D 75/5883 |
| 2008/0310769 | A1 * | 12/2008 | Misch | A45C 1/04 383/42 |
| 2010/0177993 | A1 * | 7/2010 | Chen | B65D 33/2533 383/127 |
| 2011/0103714 | A1 * | 5/2011 | Steele | B65D 75/008 383/2 |

FOREIGN PATENT DOCUMENTS

| | | | | |
|---|---|---|---|---|
| GB | 2454566 A | * | 5/2009 | B65D 35/10 |
| JP | 200946189 A | * | 5/2009 | B65D 25/42 |

* cited by examiner

*Primary Examiner* — Bryon Gehman
(74) *Attorney, Agent, or Firm* — Dinsmore & Shohl LLP

(57) ABSTRACT

A flexible pouch having a fitment with a neck having a large diameter and child safety cap is provided. The pouch is configured to hold a product not fit for human consumption, such a detergent. The large diameter neck makes the neck difficult to grip by a child so as to make it difficult for a child to manipulate the safety cap. Further, the child safety cap makes accessing the contents difficult for a child.

14 Claims, 5 Drawing Sheets

POUCH WITH CHILD PROOF FITMENT

CROSS-REFERENCE TO RELATED APPLICATIONS

This application claims priority of U.S. Provisional Application 62/058,849 filed Oct. 2, 2014, the contents of which are incorporated herein by reference.

BACKGROUND OF THE INVENTION

Flexible pouches made from sheets laminate material that either folded, overlaid, or a combination there of are known. The folded/overlaid laminate sheets are typically sealed along the perimeter defining the flexible pouch by way of ultra-sonic welding, or other methods known to those skilled in the art.

Known flexible pouch can incorporate a fitment with resealable cap to secure liquid or other product, or can incorporate a press to seal or other similar type closure providing a closable opening to the flexible pouch. Flexible pouches are also known to incorporate a gusset to increase the internal volume of the pouch.

Soap balls are individual balls of laundry soap. An individual soap ball is configured for use in a single washing cycle. The soap balls may be sold in laminate pouches. Such laminate pouches having an opening that is re-sealable with a sealing line such as an elongated coupling structure commonly referenced as Ziploc®, meaning they may be opened and closed so as to form a seal. Accordingly, the soap balls may be accessed by unintended users such as children.

Accordingly, it remains desirable to have a soap ball container wherein the opening is fitted with a child-resistant cap so as to prevent an unintended user from accessing soap balls.

SUMMARY OF THE INVENTION

A flexible pouch of the present disclosure includes a fitment with at large diameter opening. The opening is covered by a resealable cap that is secured with a child proof safety type design. The flexible pouch includes a front and back panel. The front and back panel are sealed to each other around a perimeter of the pouch, and the fitment is sealed between the front and back panels.

The large diameter opening of the fitment allows products to be stored in the pouch. Further the larger diameter opening requires a hand with a larger grip, relative to a child, to manipulate, making the opening of the cap further difficult for a child. The child proof safety design of the cap prevents/restricts a young child from accessing the contents of the flexible pouch. Incorporating the larger diameter opening and the child proof cap together into a single pouch design provides a flexible pouch that is ideal for holding larger items that might pose a risk to children, one such example is a soap balls.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE INVENTION

Figure 1:
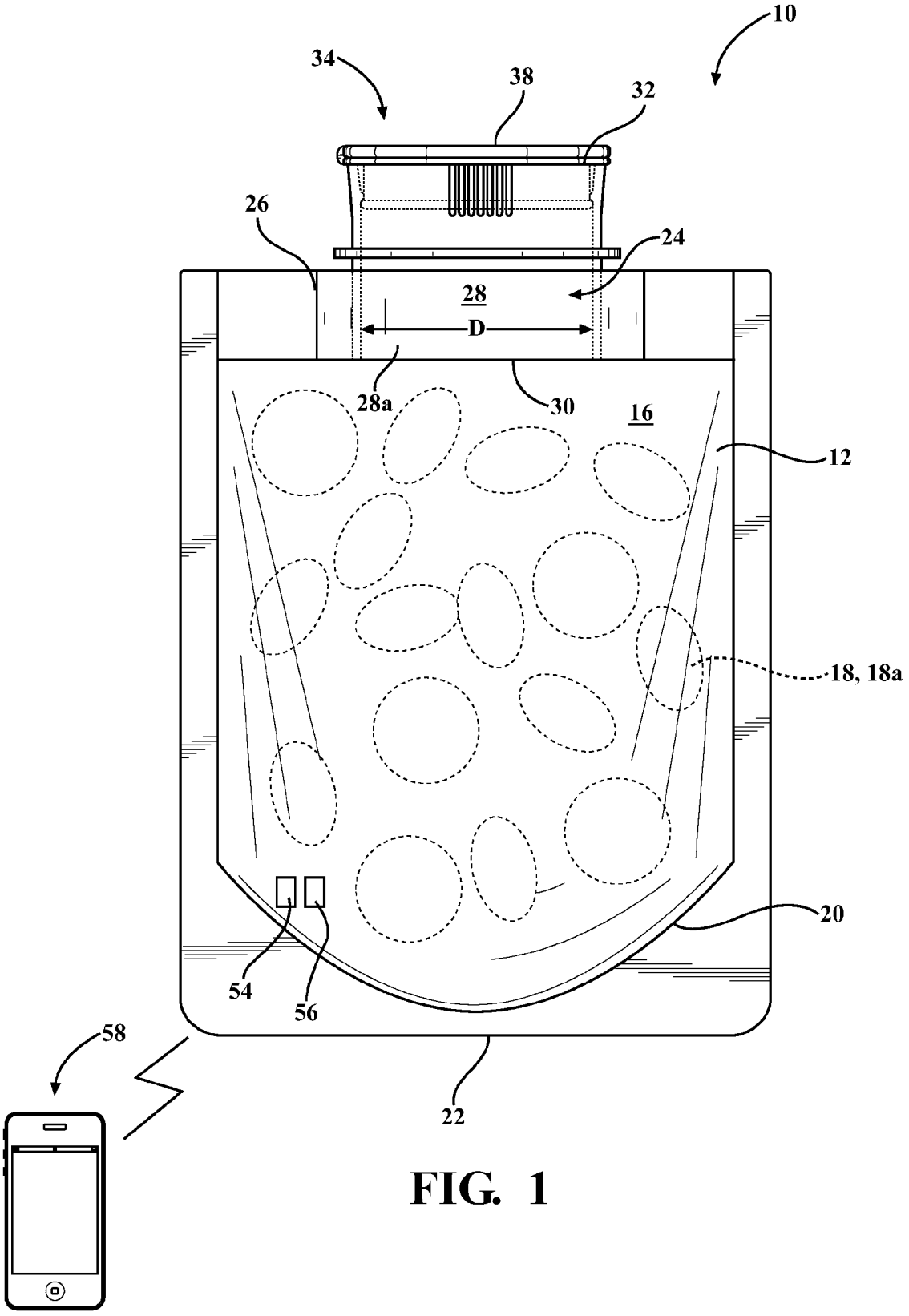
FIG. 1 is a front view of the pouch.

The present disclosure is directed to a flexible pouch having a fitment with a neck having a large diameter and child safety cap. The large diameter neck makes the neck difficult to grip by a child so as to make it difficult for a child to manipulate the safety cap. Further, the child safety cap makes accessing the contents difficult for a child.

With reference now to FIG. 1-4, a first aspect of the flexible pouch 10 is provided. The flexible pouch 10 is made from a flexible material, preferably an extrusion or a laminate composed of sheets of plastic and aluminum or the like. The pouch 10 may be formed and/or filled using conventionally known manufacturing techniques such as a horizontal form-fill-seal machine with single or multiple lanes, a flatbed premade pouch 10 machine, a vertical form-fill-seal machine, or the like.

The pouch 10 includes a front panel 12, opposite a back panel 14 so as to form a pouch body 16 configured to receive a product such as detergent 18. Preferably, the detergent 18 has a generally spherical shape having a diameter of at least one inch. Such forms of detergent 18 are currently known and used and are commonly referenced as a soap ball 18*a*. An outer layer of material of respective front and back panels 12, 14 may include preprinted information such as a logo or the like to provide the customer with information regarding the contents of the pouch 10. The front and back panels 12, 14 are sealed along the peripheral side edges. A gusset 20 may be inserted along a bottom edge 22 of and sealed to the front and back panels 12, 14 so as to allow the pouch body 16 to expand.

The pouch 10 includes a fitment 24. The fitment 24 may be inserted along a top edge or corner of the pouch body 16 and sealed to the front and back panels 12, 14. The pouch 10 may be filled with soap balls 18*a* before the fitment 24 is inserted or after the fitment 24 is inserted by filling through the fitment 24.

The fitment 24 includes a base 26 and a neck 28 having a generally uniform diameter, as indicated by "D". The neck 28 defines the height of the fitment 24 and includes a bottom opening 30 and a top opening 32 so as to form a passage 28*a* for which the contents of the pouch body 16 may exit. Preferably, the diameter of the neck 28 is uniform and is at least two and a half (2.5) inches. Preferably, the diameter "D" of the neck 28 is three and a half (3.5) inches. However, it should be appreciated that the diameter "D" of the neck 28 may be as much as four (4) inches. Accordingly, the dimensions of the neck 28 are difficult for a child to hold onto and thus makes opening of the pouch 10 more difficult for a child relative to fitments with smaller neck diameter. As used herein, a child refers to a person under the age 4.5 years.

The pouch 10 further includes a child safety cap 34. The child safety cap 34 allows product to be stored in the flexible pouch 10 that is not desirable for child use, for example laundry detergent 18 in the form of soap balls 18*a*, or other chemical products, marijuana or other adult substances, etc.

The safety cap 34 is releasably secured to the top opening 32 of the fitment 24. The safety cap 34 requires a predetermined amount of motor skills and strength to manipulate. The child safety cap 34 covers the top opening 32 of the fitment 24. FIGS. 1-4 show a first aspect of the child safety cap 34. The child safety cap 34 includes a cap 34 and a tab 36. The tab 36 secures the cap 34 to the neck 28. The cap 34 and tab 36 are formed of a generally resilient material such as polypropylene. The cap 34 includes a top cover 38 and a side wall 40. The side wall 40 is disposed on a bottom surface of the top cover 38.

Figure 2:
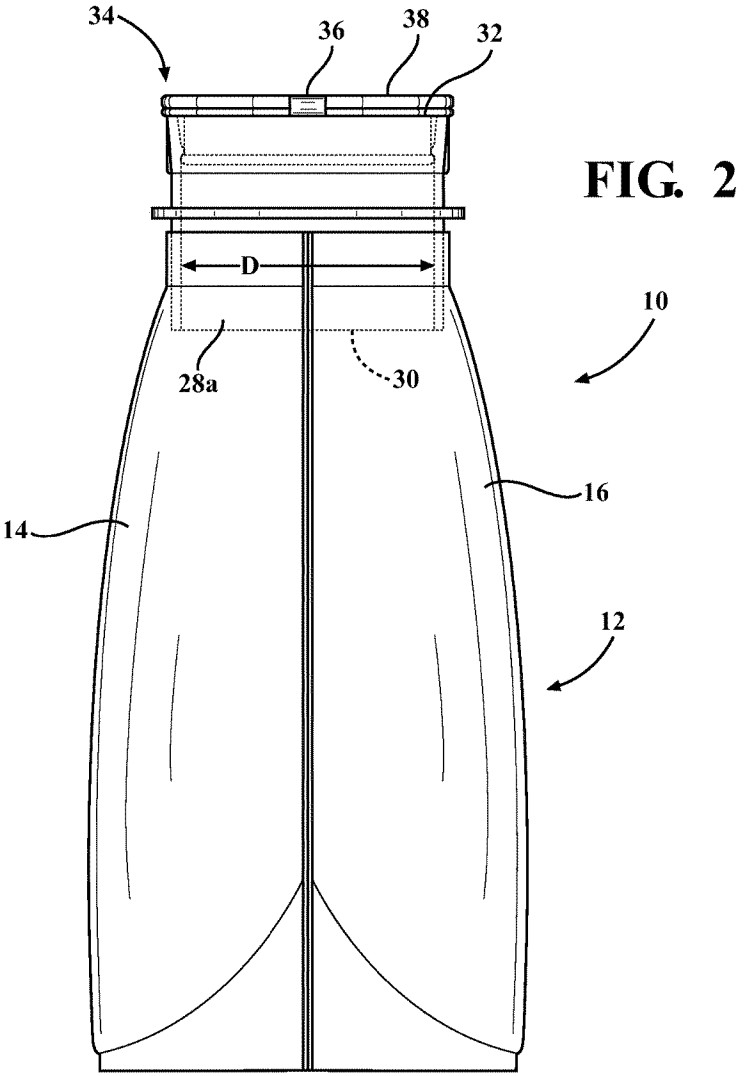
FIG. 2 is a side view of the pouch shown in FIG. 1.
Figure 3:
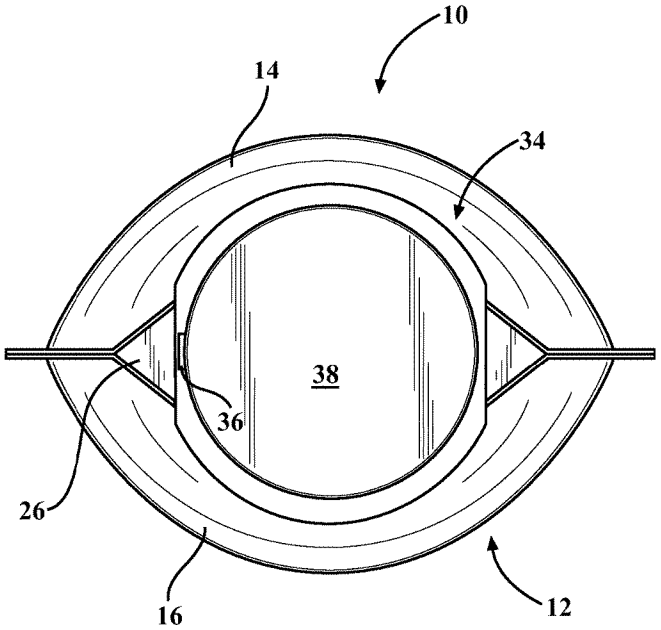
FIG. 3 is a top down view of the pouch shown in FIG. 1.

The neck 28 includes an inner ledge 42 so as to form a top lip 44 having an inner wall surface 44*a*. The inner wall surface 44*a* is concentric to the side wall 40 and is dimensioned so as to fittingly receive the side wall 40 in a tensioned engagement. The neck 28 is also formed of a resilient material such as polypropylene. As shown in FIG. 2, the side wall 40 of the cap 34 is fitted within the top lip 44 of the neck 28, wherein a rib 46 radially disposed on a distal bottom edge 22 of the side wall 40 is pressed past the inner ledge 42 of the neck 28. Thus the inner ledge 42 of the neck 28 serves to help prevent the cap 34 from being disengaged from the neck 28.

Figure 4:
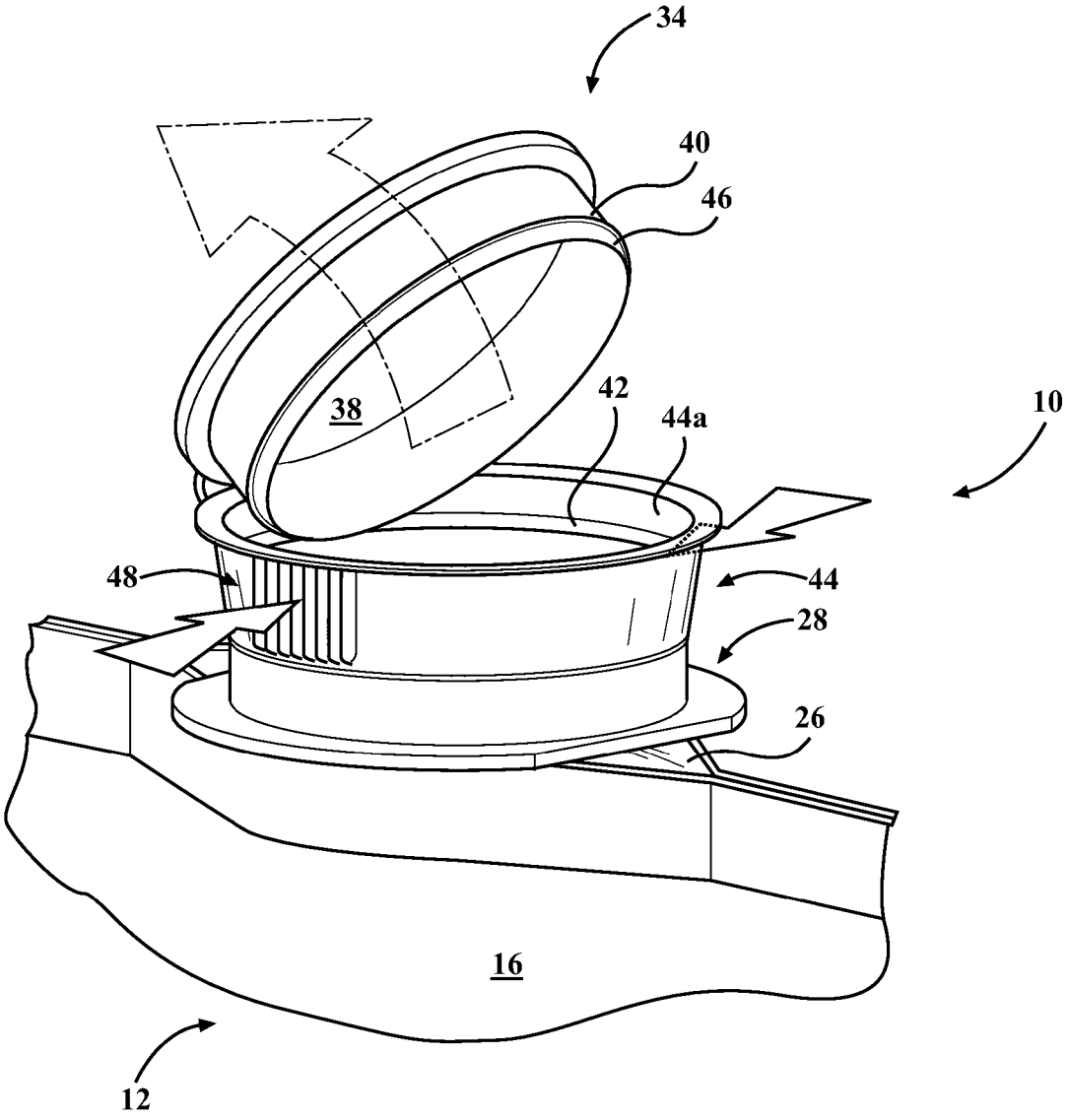
FIG. 4 is an isolated view of the cap of the pouch shown in FIG. 1.

FIG. 4 shows a pinching force applied to raised portions 48 of the neck 28 causing the cap 34 to become disengage from the neck 28. In particular, the resilient neck 28 is pressed inwardly which causes the side wall 40 of the cap 34 to bend, wherein the bending of the side wall 40 creates a dimensional mismatch with the inner surface of the top lip 44, causing the cap 34 to disengage. It should be further appreciated that the force required to pinch the neck 28 so as to disengage the cap 34 is increased as a function of the diameter of the neck 28. In particular, the diameter of the neck 28 makes it difficult for a child to exert a pinching force necessary for the cap 34 to disengage.

Figure 5:
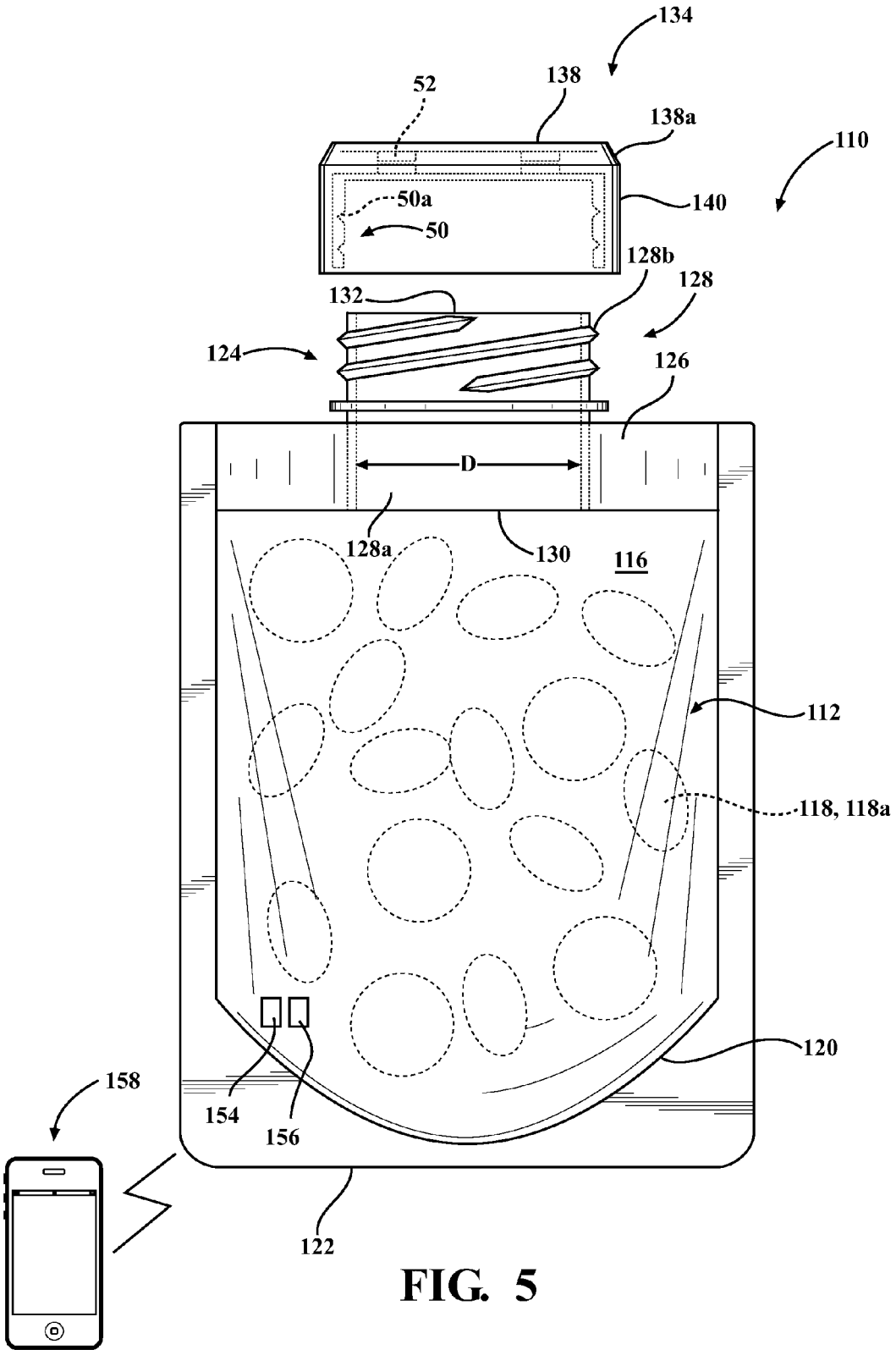
FIG. 5 is a front view of another aspect of the pouch.
Figure 7:
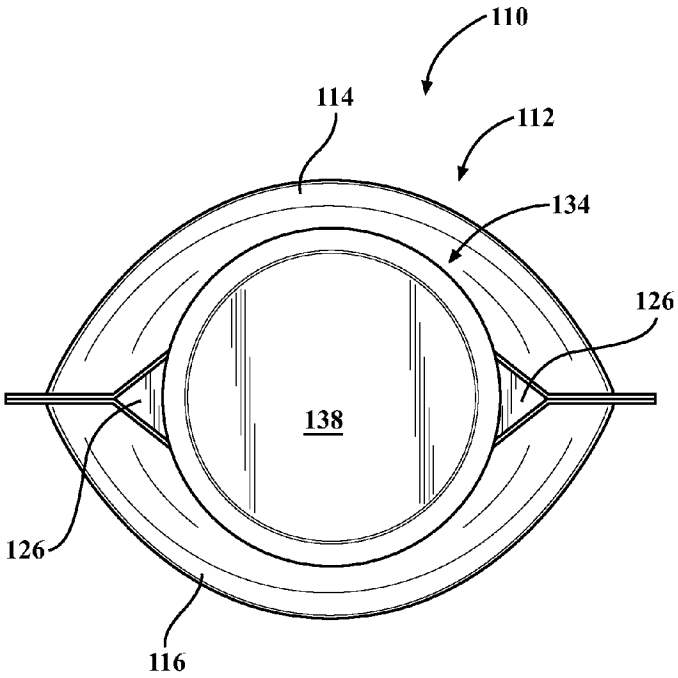
FIG. 7 is a top down view of the pouch shown in FIG. 5.
Figure 6:
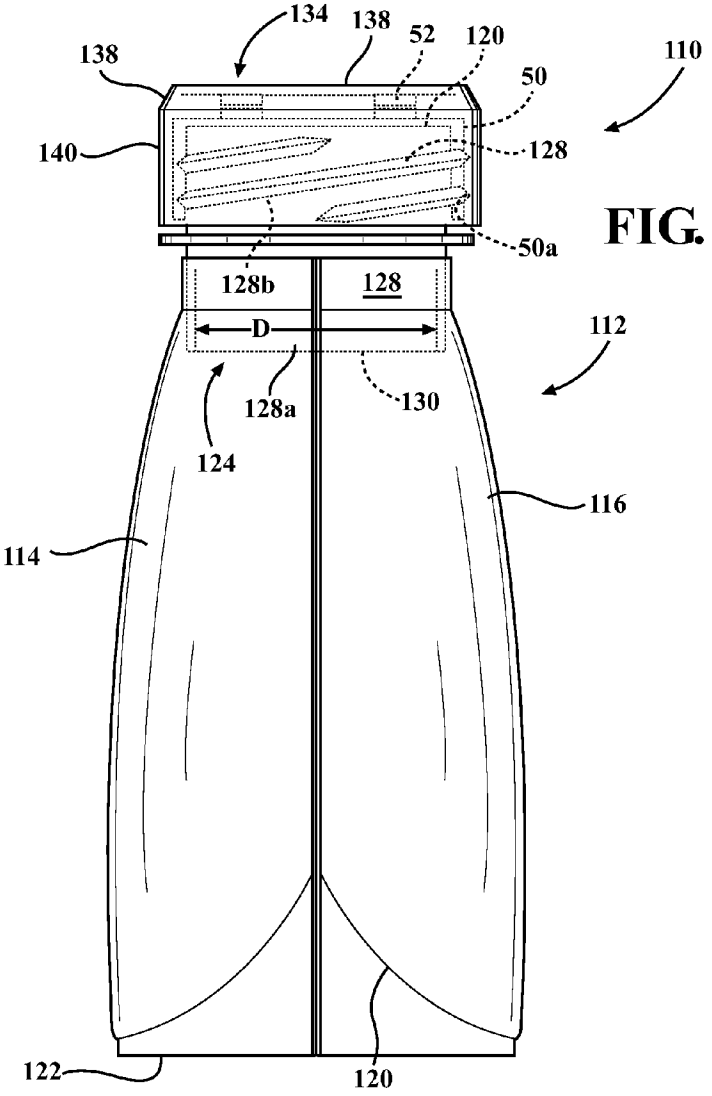
FIG. 6 is a side view of the pouch shown in FIG. 5.

With reference now to FIGS. 5-7 another aspect of the safety cap 34 is provided, wherein like elements are referenced by like numbers increased by 100. The pouch 110 includes a pouch body 116 formed by front and back panels 112, 114. The pouch 110 further includes a bottom gusset 120 configured to allow the pouch body 116 to expand.

The pouch 110 includes a fitment 124. The fitment 124 may be inserted along a top edge or corner of the pouch body 116 and sealed to the front and back panels 112, 114. The pouch 110 may be filled before the fitment 124 is inserted or after the fitment 124 is inserted by filling through the fitment 124.

The fitment 124 includes a base 126 and a neck 128 having a generally uniform diameter. The neck 128 defines the height of the fitment 124 and includes a bottom opening 130 and a top opening 132 so as to form a passage 128*a* for which the contents of the pouch body 116 may exit. Preferably, the diameter of the neck 128 is uniform and is at least two and a half (2.5) inches. Preferably, the diameter of the neck 128 is three and a half (3.5) inches. However, it should be appreciated that the diameter of the neck 128 may be as much as four (4) inches. Accordingly, the dimensions of the neck 128 are difficult for a child to hold onto and thus makes opening of the pouch 110 more difficult for a child relative to fitments with smaller neck diameter.

A top portion of the neck 128 includes a thread 128*b* formed on an outer surface of the top portion of the neck 128. The safety cap 134 includes a top cover 138 and a side wall 140. Unlike the side wall 40 shown in the first aspect of the safety cap 34, the side wall 140 of the second aspect is contiguous with the top cover 138 and disposed on a peripheral edge 138*a* of the top cover 138. The side wall 140 includes an insert 50 rotatable with respect to the side wall 40. An inner surface of the insert 50 includes a thread 50*a*. The insert 50 includes a fixing mechanism 52 that allows the insert 50 to freely spin within the cap 134 when no downward pressure is applied and the interior threads 50*a* of the insert 50 remain stationary relative to the fitment 124. Accordingly, the cap 134 cannot be removed unless a downward pressure is applied. The fixing mechanism 52 is configured to engage the insert 50 with the cap 134 so as to have the insert spin with the cap 134. Accordingly, the interior threads 50*a* move relative to the fitment 24 allowing the cap 134 to be removed. Any fixing mechanism 52 currently known and used in the art may be adapted for use herein, illustratively including fixing mechanisms found on Advil® bottles.

The pouch 10 may further include a near field communication (NFC) chip 54 or a bar code 56. The NFC Chip 54 or bar code 56 may be used in combination with a portable electronic device 58 to provide the user with emergency information in the event a child swallows a soap ball 18*a*. The NFC chip 54 and the bar code 56 may also be used to track sales and provide registration information of the types of goods sold packaged in the pouch 110. If marijuana is packaged in the pouch 110, better records can me kept of those sales, which may be needed depending on the legal regulations placed on the product and the products sales.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

I claim:

1. A flexible pouch comprising:

a pouch body;

a detergent having a generally spherical shape having a diameter of at least one inch;

a fitment having a neck, the neck having a bottom opening, a top opening, and a top portion, the top portion having an inner wall surface, an inner ledge disposed on an inner wall surface so as to form a top lip, the neck having a generally uniform diameter, wherein the generally uniform diameter is difficult for a child to grip, the neck made of a resilient material;

a safety cap having a top cover and a side wall, the side wall configured to engage the inner wall surface of the top portion of the neck, the safety cap made of a resilient material and thus releasably secured to the top opening of the fitment, the safety cap requiring a predetermined amount of motor skills to manipulate; and wherein the neck is configured to be pressed inwardly causing the side wall of the safety cap to bend, wherein the bending of the side wall of the safety cap and the inner wall surface creates a dimensional mismatch with the inner surface of the top lip, causing the safety cap to disengage, wherein the force required to pinch the neck so as to disengage the cap is increased as a function of the diameter of the neck.

2. The pouch as set forth in claim 1, wherein the safety cap having a distal end of the side wall that is ribbed and configured to fit past the inner ledge so as to be secured within the neck.

3. The pouch as set forth in claim 1, wherein the resilient material is polypropylene.

4. The pouch as set forth in claim 3, wherein the top portion of the neck includes a raised surface portion.

5. The pouch as set forth in claim 4, further including a near field communication chip configured to carry a signal, the signal containing information for treating an instance of swallowing the detergent.

6. The pouch as set forth in claim 4, further including a bar code, the bar code linked to a website providing information for treating an instance of swallowing the detergent.

7. The pouch as set forth in claim 1, wherein the generally uniform diameter is between two and a half and four inches.

8. A flexible pouch comprising:

a pouch body;

a detergent having a generally spherical shape having a diameter of at least one inch;

a fitment having a neck, the neck having a bottom opening, a top opening, and a thread disposed on an outer surface of the neck, the neck having a generally uniform diameter, wherein the generally uniform diameter is difficult for a child to grip; and a safety cap having a top cover and a side wall contiguous with the top cover and disposed on a peripheral edge of the top cover, an insert rotatably disposed within the side wall of the top cover; a fixing mechanism configured to engage the insert with the cap so as to have the insert spin with the cap when a downward force is applied on the top cover of the safety cap, thus the safety cap being closable and releasably secured to the top opening of the fitment, the safety cap requiring a predetermined amount of motor skills to manipulate the safety cap.

9. The pouch as set forth in claim 8, wherein the neck and the safety cap are made of a resilient material.

10. The pouch as set forth in claim 9, wherein the resilient material is polypropylene.

11. The pouch as set forth in claim 10, wherein the top portion of the neck includes a raised surface portion.

12. The pouch as set forth in claim 11, wherein the generally uniform diameter is between two and a half and four inches.

13. The pouch as set forth in claim 12, further including a near field communication chip configured to carry a signal, the signal containing information for treating an instance of swallowing the detergent.

14. The pouch as set forth in claim 12, further including a bar code, the bar code linked to a website providing information for treating an instance of swallowing the detergent.

* * * * *